US006249662B1

(12) United States Patent
Lee

(10) Patent No.: US 6,249,662 B1
(45) Date of Patent: Jun. 19, 2001

(54) DEVICE FOR ADJUSTING PHOTORECEPTOR BELT TENSION IN PRINTING APPARATUS

(75) Inventor: Jong-chan Lee, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/456,484

(22) Filed: Dec. 7, 1999

(30) Foreign Application Priority Data

Dec. 7, 1998 (KR) ..... 98-53469

(51) Int. Cl.[7] ..... G03G 15/00
(52) U.S. Cl. ..... 399/165; 399/38; 399/116
(58) Field of Search ..... 399/165, 38, 82, 399/107, 116; 242/410; 198/810.01, 810.04

(56) References Cited

U.S. PATENT DOCUMENTS 4,551,001 * 11/1985 Yokota ..... 399/116
5,717,984 * 2/1998 Wong ..... 399/165
6,085,053 * 7/2000 Sacki ..... 399/165

FOREIGN PATENT DOCUMENTS 60-186877 9/1985 (JP) .
62-27209 2/1987 (JP) .
8-241014 9/1996 (JP) .

OTHER PUBLICATIONS

English translation of Japanese Office Action 11–346666.

* cited by examiner

*Primary Examiner*—Sophia S. Chen
(74) *Attorney, Agent, or Firm*—Sughrue, Mion, Zinn, Macpeak & Seas, PLLC

(57) ABSTRACT

A device for adjusting tension applied to a photoreceptor belt in a printing apparatus. The tension adjusting device includes a control mechanism for controlling the operation of a driving motor such that a tension adjusting mechanism operates in three modes including a normal print mode where the tension is applied to the photoreceptor belt for normal printing, a loosened tension mode where the tension to the photoreceptor belt is loosened due to suspension of the printing operation, and a belt replace mode where the tension to the photoreceptor belt is released so that the photoreceptor belt can be replaced. For mode switching, the control mechanism controls the driving motor according to the position of the tension adjusting mechanism, detected by a sensing mechanism, or by detecting the load applied to the driving motor. Therefore, during suspension of the printing operation, the mode can be switched into the loosened tension mode, so that the tension to the photoreceptor belt can be released without damage to the photoreceptor belt. As a result, a partial stiffening and folding of the photoreceptor belt at the bent portion thereof can be prevented.

9 Claims, 5 Drawing Sheets

DEVICE FOR ADJUSTING PHOTORECEPTOR BELT TENSION IN PRINTING APPARATUS

BACKGROUND OF THE INVENTION

1. Field of the Invention

The present invention relates to a printing apparatus, such as a printer or photocopier, and more particularly, to a device for adjusting the tension applied to a photoreceptor belt that rotates along a predetermined track.

2. Description of the Related Art

In printing apparatuses which are used to form a desired image on a printing paper, a latent electrostatic image is formed on a photoreceptor such as a photosensitive drum or a photoreceptor belt, and developed by a toner of a predetermined color. Then, the developed image is transferred to a print paper.

FIG. 1 is a schematic view of major elements of a conventional printing apparatus. Referring to FIG. 1, the conventional printing apparatus includes a photoreceptor belt 10, and a driving roller 20, a backup roller 30, and a tension roller 40, which circulate the photoreceptor belt 10 along a given track.

A major charging station 50 for charging the photoreceptor belt 10 is placed over a part of the photoreceptor belt 10. A laser scanning unit (LSU) 60 for emitting a laser beam onto the photoreceptor belt 10 according to an image signal, to form a latent electrostatic image thereon, and a development unit 70 for developing the latent electrostatic image with a developer containing a toner of a predetermined color and a liquid carrier, are installed below the photoreceptor belt 10. In general, color printers include a plurality of LSU's 60 and a plurality of development units 70 which contain different color developer.

The liquid carrier is removed from the developer which is applied to the photoreceptor belt 10, by a drying roller 81 and a heating roller 82, thereby drying the surface of the photoreceptor belt 10. As a result, a toner image formed by the toner remains on the latent electrostatic image of the photoreceptor belt 10. The toner image is transferred onto a printing paper 93 by a transfer roller 91, which is installed parallel to the backup roller 30, with the photoreceptor belt 10 is interposed therebetween. The printing paper 93 is supplied between the transfer roller 91 and a pressure roller 92, and the toner transferred onto the printing paper 93 is heated and pressed by the pressure roller 92, so that the toner is fixed onto the printing paper 93.

Also, the printing apparatus includes a tension adjusting device 100 for adjusting the tension of the photoreceptor belt 10. The tension adjusting device 100 adjusts the tension applied to the photoreceptor belt 10 by applying pressure to the tension roller 40 or releasing pressure therefrom.

FIG. 2 is a perspective view of the tension adjusting device of FIG. 1. The tension adjusting device 100 of FIG. 2 uses a spring 142 and an eccentric cam 150. In detail, the conventional tension adjusting device 100 includes an auxiliary frame 110, which is slidably installed in a main frame 1 and supports the tension roller 40 rotatably, a fixed frame 120 fixed to the main frame 1, and a guide bar 130 for connecting the auxiliary frame 110 and the fixed frame 120.

The auxiliary frame 110 has grooves 111 to which a rotary shaft 41 of the tension roller 40 is coupled, and a part 112 which covers the grooves 111 to press the rotary shaft 41 of the tension roller 40. The fixed frame 120 has a hole 121 at the center portion, through which the guide bar 130 passes.

The guide bar 130 is inserted into the hole 121 to be movable, and one end of the guide bar 130 is coupled to the auxiliary frame 110 by a coupling pin 113. A screw part 131 is formed at the middle portion of the guide bar 130, and is screw-coupled with a nut 141. A spring 142 is installed around the guide bar 130. The eccentric cam 150 that rotates by a driving motor 160, is installed at the other end of the guide bar 130, to control the elastic force applied to the spring 142. Also, a pressing ring 143 is slidably installed around the guide bar 130 such that it can press the spring 142 as the eccentric cam 150 rotates.

In the operation of the tension adjusting device 100 having the above structure, in a normal print mode where the printing apparatus normally operates for printing, the eccentric cam 150 presses the pressing ring 143, so that the guide bar 130 is pushed toward a direction A. Accordingly, the tension roller 40 is moved in the direction A, so that the tension is applied to the photoreceptor belt 10. In the case when a worn belt needs to be replaced (referred to as belt replace mode), the pressure applied to the spring 142 is released by the rotation of the eccentric cam 150, so that the tension roller 40 moves in a direction B. Accordingly, the tension applied to the photoreceptor belt 10 is released.

As described above, the conventional tension adjusting device 100 is designed to operate in two modes: the normal print mode and the belt replace mode. Thus, even when the printing operation stops due to reasons other than the replacement of the photoreceptor belt 10, the tension applied to the photoreceptor belt 10 remains. Also, if the tension applied to the photoreceptor belt 10 is released by switching the normal print mode into the belt replace mode, in this case, the photoreceptor belt 10 is loosened and falls down, contacting other units such as the LSU 60 (see FIG. 1) or the development unit 70 (see FIG. 1), installed below the photoreceptor belt 10, causing contamination or damage to the surface of the photoreceptor belt 10.

Meanwhile, in the case where the operation of the printing apparatus stops, if the photoreceptor belt 10 is left for a long time while the tension is applied thereto, three bent portions of the photoreceptor belt 10, contacting the driving roller 20, the backup roller 30 and the tension roller 40, are partially stiffened, resulting in folds on the photoreceptor belt 10. Such folds in the photoreceptor belt 10 distort the image developed thereon during a printing process, thereby deteriorating the quality of development, and shortening the life of the photoreceptor belt 10.

SUMMARY OF THE INVENTION

It is an object of the present invention to provide a device for adjusting the tension of a photoreceptor belt in a printing apparatus, which is capable of appropriately letting loose the tension applied to the photoreceptor belt during suspension of a printing operation, thereby preventing generation of folds due to a partial stiffening of the photoreceptor belt.

To achieve the object of the present invention, there is provided a tension adjusting device for printing apparatuses, including: means for rotatably supporting a tension roller; means for adjusting the tension applied to a photoreceptor belt by pushing the tension roller in a direction to apply tension to the photoreceptor belt, or by releasing the tension from the photoreceptor belt; a driving motor for driving the tension adjusting means; and means for controlling the operation of the driving motor such that the tension adjusting means operates in three modes, including: a normal print mode where the tension is applied to the photoreceptor belt for a normal printing, a loosened tension mode where the tension to the photoreceptor belt is loosened due to the suspension of the printing operation, and a belt replace mode where the tension to the photoreceptor belt is released to replace the photoreceptor belt.

Preferably, the control means includes means for sensing the position of the tension adjusting means, and the control means recognizes the modes according to the position of the tension adjusting means, detected by the sensing means as the driving motor operates, and controls the driving motor according to the detected mode.

Preferably, the control means recognizes the modes according to the load which is applied to the driving motor as the driving motor operates to shift the mode, and controls the driving motor according to the detected mode.

Therefore, the mode can be switched into a loosened tension mode during suspension of the printing operation, so that the tension applied to the photoreceptor belt can be loosened without damage to the photoreceptor belt, and folding of the photoreceptor belt, due to a partial stiffening of the photoreceptor belt at the bent portions, can be prevented.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE PREFERRED EMBODIMENTS

Figure 3:
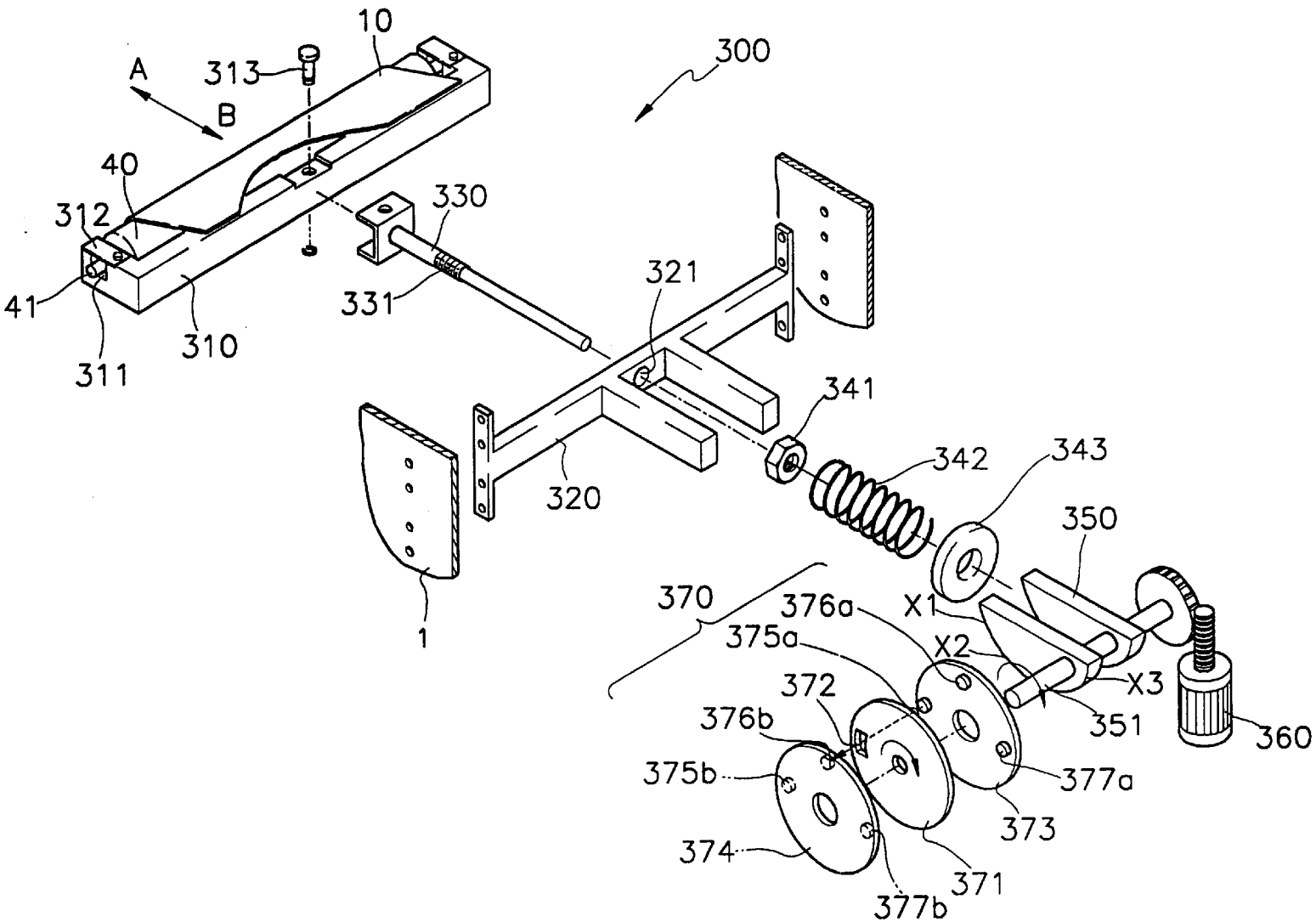
FIG. 3 is a perspective view of a tension adjusting apparatus for printing apparatuses according to an embodiment of the present invention.

In FIG. 3, a tension adjusting device 300 for printing apparatuses according to an embodiment of the present invention uses a spring 342 and an eccentric cam 350. The tension adjusting device 300 includes means for supporting the tension roller 40 of the printing apparatus, tension adjusting means for applying a tension to the photoreceptor belt 10 by pressing the tension roller 40, or releasing tension applied to the photoreceptor belt 10, a driving motor 360 for driving the tension adjusting means, and means for controlling the driving motor 360.

An auxiliary frame 310 as the supporting means is slidably installed in a main frame 1 of the printing apparatus to support the tension roller 40 to be rotatable. An installation groove 311 in which a rotary shaft 41 of the tension roller 40 is seated, is formed in the auxiliary frame 310. Also, the installation groove 311 is covered with an elastic plate 312 pressing the rotary shaft 41 of the tension roller 40.

The tension adjusting means includes a fixed frame 320 which is fixed to the main frame 1, and a guide bar 330 for connecting the auxiliary frame 310 and the fixed frame 320. The fixed frame 320 has a hole 321 at the center portion, through which the guide bar 330 passes. The guide bar 330 is inserted into the hole 321 to be movable, and one end of the guide bar 330 is coupled to the auxiliary frame 310 by a coupling pin 313. A screw part 331 is formed at the middle portion of the guide bar 330, and is screw-coupled with a nut 341. A spring 342 is installed around the guide bar 330. The eccentric cam 350 that rotates by the driving motor 360, is installed at the other end of the guide bar 330, to control the elastic force applied to the spring 342. Also, a pressing ring 343 for pressing the spring 342 with the rotation of the eccentric cam 350 is slidably installed around the guide bar 330. The driving motor 360 rotates the eccentric cam 350 of the tension adjusting means.

The control means, which is one of the major features of the present invention, controls the driving motor 360 in three modes including a normal print mode, a belt replace mode and a loosened tension mode. That is, during suspension of the printing operation, the driving motor 360 is controlled in the loosened tension mode, to release the tension applied to the photoreceptor belt 10. The control means includes a sensing means 370 for sensing the position of the rotating eccentric cam 350, and controls the driving motor 360 according to the position of the rotating eccentric cam 350, which is detected by the sensing means 370 when the driving motor 360 operates to switch modes.

The sensing means 370 includes a rotary plate member 371, a slit 372, fixed plate members 373 and 374, and three optical sensors.

The rotary plate member 371 is installed to the rotary shaft 351 of the eccentric cam 350, and rotates by the motor 360 together with the eccentric cam 350. Also, the slit 372 formed at a predetermined portion of the rotary plate member 371 allows the light emitted from the optical sensors to pass the rotary plate member 371. The fixed plate members 373 and 374 are installed at either side of the rotary plate member 371, and are separated by a predetermined distance, with the fixed plate members 373 and 374 not rotating together with the rotary shaft 351. Three optical sensors are installed at each surface of the fixed plate members 373 and 374 facing each other. That is, light emitting portions 375*a*, 376*a*, and 377*a*, of the optical sensors are installed in the fixed member 373 and light receiving portions 375*b*, 376*b*, and 377*b*, are installed in the fixed member 374.

In the operation of the tension adjusting device having the above structure, in the normal print mode, the eccentric cam 350 presses the pressing ring 343, thereby pushing the guide bar 330 in a direction A. Accordingly, the tension roller 40 moves in the direction A, so that tension is applied to the photoreceptor belt 10. In this state, a portion X1 of the eccentric cam 350 contacts the pressing ring 343 and the light emitted from the light emitting portion 375*a* of the first optical sensor passes the slit 372 of the rotary plate member 371, and is detected by the light receiving portion 375*b*. However, the lights emitted from the light emitting portions 376*a* and 377*a* of other optical sensors are blocked by the rotary plate member 371, so that they cannot reach the light receiving portions 376*b* and 377*b*. When only the light receiving portion 375*b* of the first optical sensor can detect the light, is the state recognized as a normal print mode.

Figure 1:
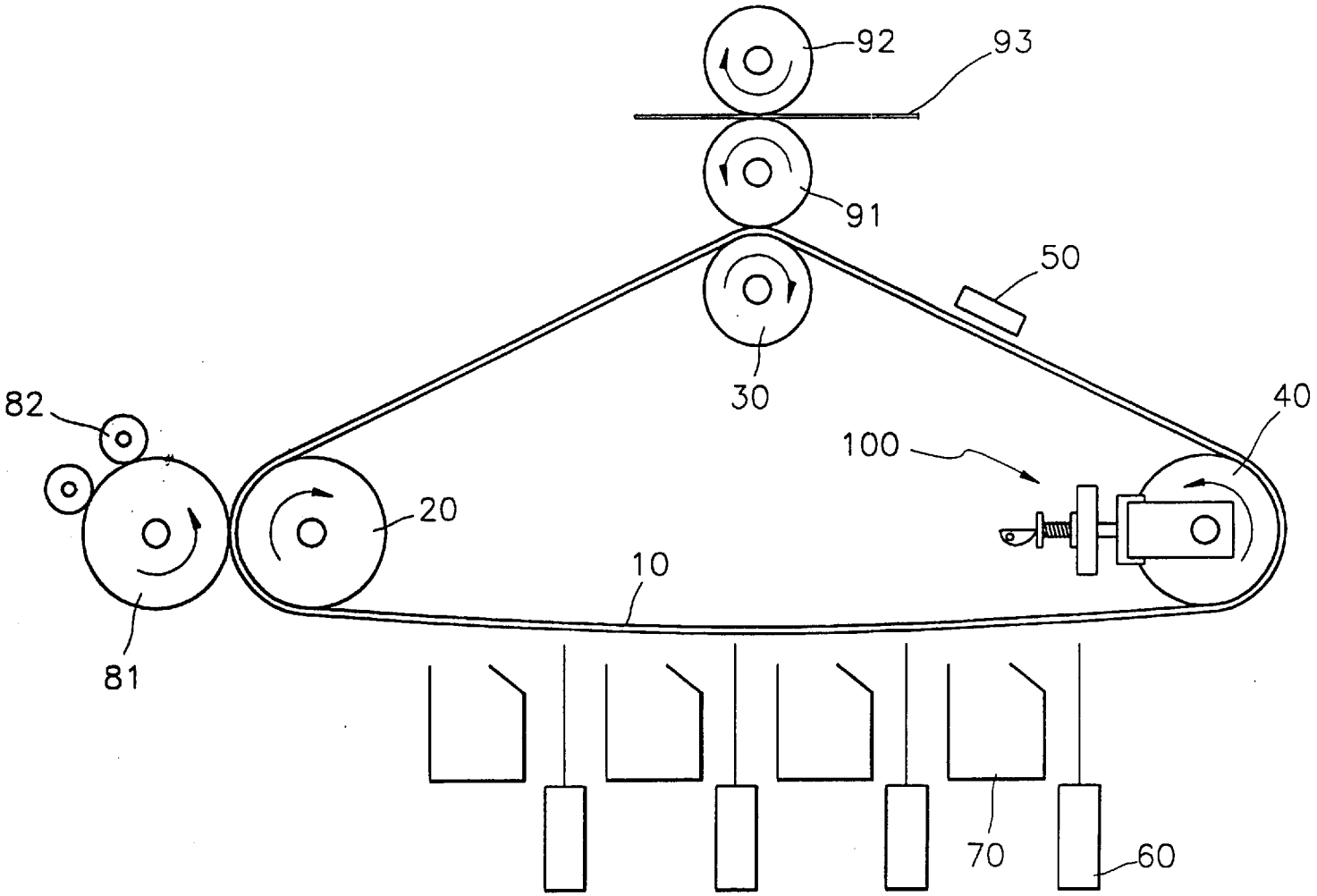
FIG. 1 (PRIOR ART)
FIG. 1 is a schematic view of major elements of a conventional printing apparatus.
Figure 2:
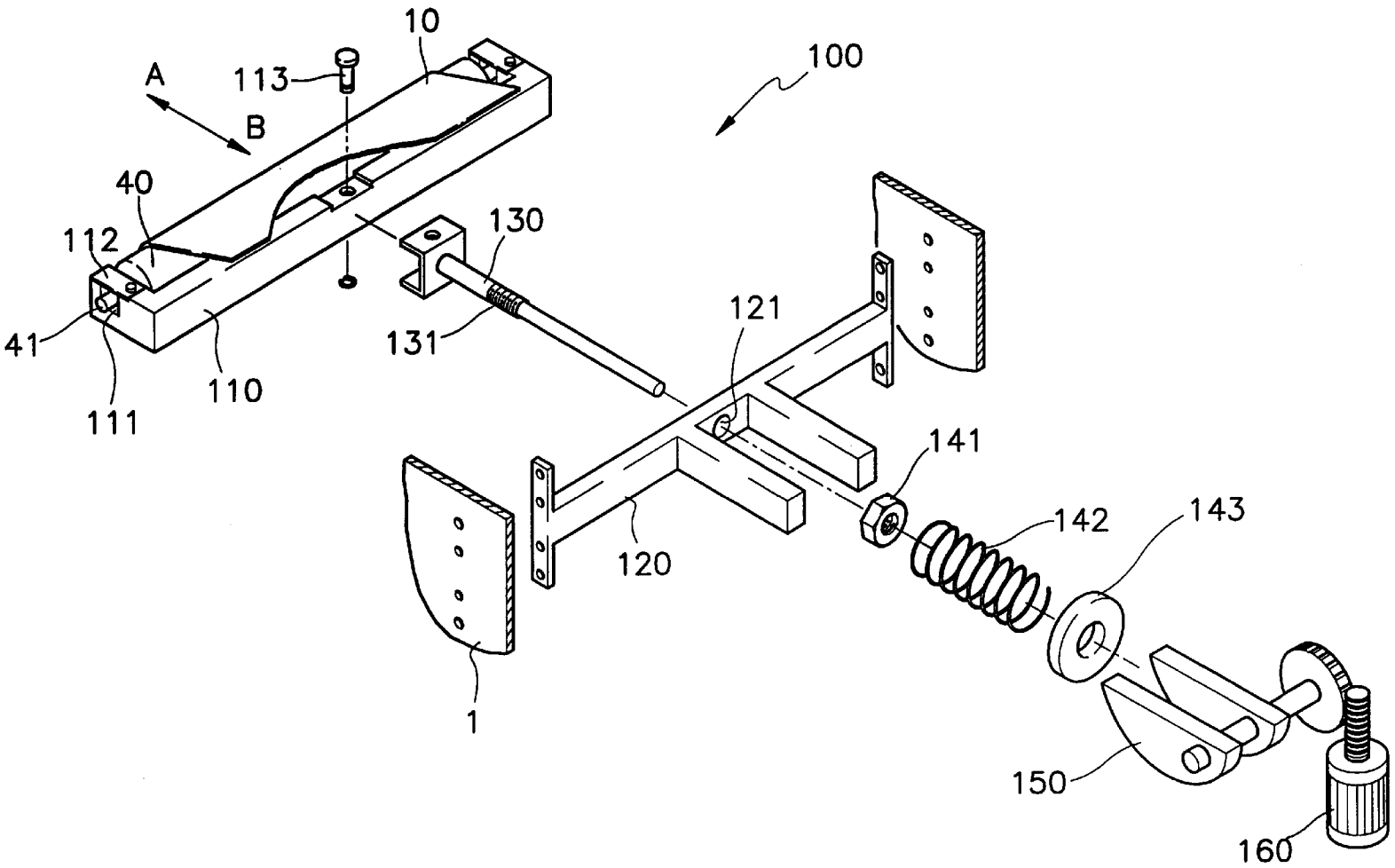
FIG. 2 (PRIOR ART)
FIG. 2 is a perspective view of the tension adjusting device of FIG. 1.

When the mode is switched into the loosened tension mode due to suspension of the printing operation, the driving motor 360 operates by a printing stop signal, and the eccentric cam 350 and the rotary plate member 371 rotate together. When the eccentric cam 350 rotates a predetermined amount and a portion X2 of the eccentric cam 350 contacts the pressing ring 343, the slit 372 of the rotary plate member 371 is located between the light emitting portion 376*a* and the light receiving portion 376*b* of the second optical sensor. That is, when only the light receiving portion 376*b* of the second optical sensor can detect the light, the control means recognizes the state as the tension release state, thereby ceasing operation of the driving motor 360. As a result, the pressure applied to the tension roller 40 is loosened, and the tension roller 40 moves in the direction B a predetermined amount. Thus, the loosened tension state can be maintained for a while. The position of the portion X2 of the eccentric cam 350 is set such that the photoreceptor belt 10 does not contact other units such as the LSU 60 (see FIG. 1) or the development unit 70 (see FIG. 1) when the photoreceptor belt 10 falls down due to the loosened tension.

In the belt replace mode for replacing a worn photoreceptor belt 10, the eccentric cam 350 rotates a predetermined amount as the driving motor 360 operates, so that a portion X3 of the eccentric cam 350 contacts the pressing ring 343 and the slit 372 of the rotary plate member 371 is located between the light emitting portion 377*a* and the light receiving portion 377*b* of third optical sensor. Only the light receiving portion 377*b* of the third optical sensor can detect light, and the control means recognizes this state as the belt replace mode, thereby ceasing operation of the driving motor 360. In this state, the pressure applied to the spring 342 is completely released and the tension roller 40 moves at the end in the direction B, thereby completely releasing the tension applied to the photoreceptor belt 10.

The structure of the sensing means 370 can be modified into various forms. For example, the fixed plate members 373 and 374 may be movably installed to the rotary shaft 351 of the eccentric cam 350 while the rotary plate member 371 is fixed. Alternatively, the sensing means 370 may include only two optical sensors, and the slit is formed to be slightly longer or two slots are formed. In this case, the operation mode can be divided into three modes according to the state of optical sensors which detect the light, including a first mode where one optical sensor detects light, a second mode where both optical sensors detect light, and a third mode where the other sensor detects light. That is, the sensing means 370 can be implemented with at least two optical sensors and a slit capable of selectively passing lights detected by the two optical sensors.

As described above, the tension adjusting device 300 according to the present invention can operate in three modes including the normal print mode, the loosened tension mode and the belt replace mode, by the control means including the sensing means 370. Thus, during the suspension of the printing operation, the mode is switched into the loosened tension mode, thereby loosening the tension applied to the photoreceptor belt 10. Thus, the partial stiffening at the bent portions of the photoreceptor belt 10, and folding at those regions can be prevented.

Figure 4:
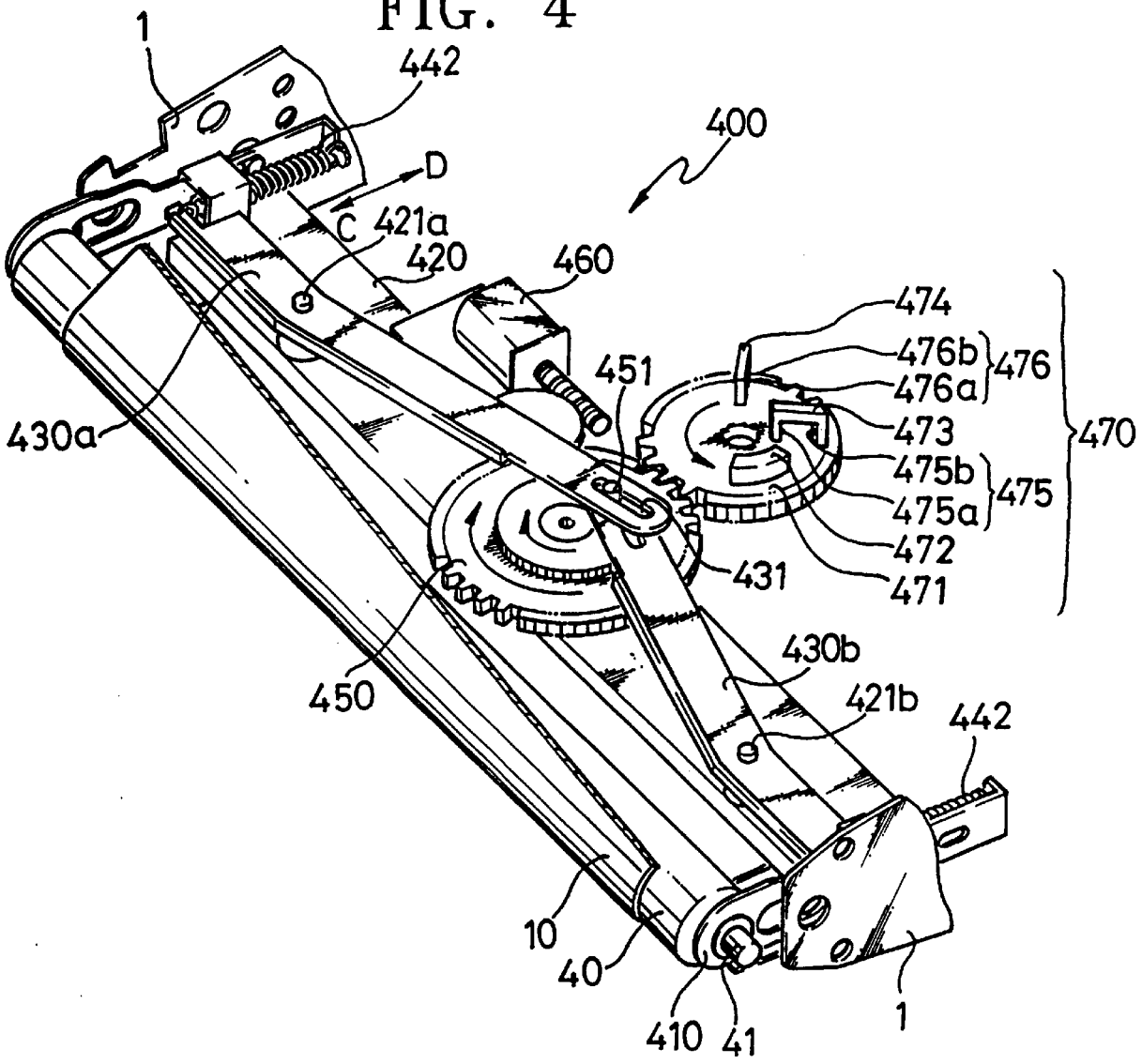
FIG. 4 is a perspective view of a tension adjusting device for printing apparatuses according to another embodiment of the present invention.

FIG. 4 is a perspective view of a tension adjusting device for printing apparatuses according to another embodiment of the present invention, which utilizes a spring 442 and rocking members 430*a* and 430*b*.

In FIG. 4, a tension adjusting device 400 includes means for supporting a tension roller 40 of the printing apparatus, tension adjusting means for applying a tension to a photoreceptor belt 10 by pressing the tension roller 40 in a direction, or releasing tension applied to the photoreceptor belt 10, a driving motor 460 for driving the tension adjusting means, and means for controlling the driving motor 460.

An auxiliary frame 410 as the supporting means is slidably installed in a main frame 1 of the printing apparatus and rotary shaft 41 of the tension roller 40 are rotatably coupled to one end of the auxiliary frame 410.

The tension adjusting means includes a fixed frame 420 that is fixed to the main frame 1, rocking members 430*a* and 430*b* and a circular rotary plate 450 which are installed on the fixed frame 420, and springs 442 each connecting the rocking members 430*a* and 430*b* to the auxiliary frame 410. The middle portions of the rocking members 430*a* and 430*b* are coupled to the fixed frame 420 by hinge pins 421*a* and 421*b*, respectively, each one end thereof is connected to the circular rotary plate 450 by the coupling of slots formed at the ends with a coupling pin 451 formed in the circular rotary plate 450, and the other ends thereof are respectively connected to the springs 442. The circular rotary plate 450 is rotatably installed on the fixed frame 420, and has the coupling pin 451 protruding at the surface thereof, and the coupling pin 451 is coupled with the slots 431 of the rocking members 430*a* and 430*b*. The springs 442 are installed between the other ends of the rocking members 430*a* and 430*b* and the other ends of the auxiliary frame 410, respectively, thereby pressing the auxiliary frame 410 in a direction C. The driving motor 460 is installed on the fixed frame 420 and rotates the circular rotary plate 450 of the tension adjusting means.

The control means, which is a characteristic feature of the present invention, controls the driving motor 460 in three modes including a normal print mode, a loosened tension mode and a belt replace mode, as in the previous embodiment. The control means includes a sensing means 470 for sensing the position of the circular rotary plate 450 and controls the driving motor 460 according to the position of the circular rotary plate 450, sensed by the sensing means 470, as the driving motor 460 operates to switch modes.

The sensing means 470 includes a rotary plate member 471, and a boss 472 and brackets 473 and 474 which are installed in the rotary plate member 471, and optical sensors 475 and 476 respectively installed in the brackets 473 and 474.

The rotary plate member 471 is installed in contact with the circular rotary plate 450 and rotates together with the circular rotary plate 450 by the driving motor 460. The boss 472 formed to protrude at a predetermined portion on the rotary plate member 471 blocks lights emitted from the optical sensors 475 and 476. The brackets 473 and 474 formed on the rotary plate member 471 are separated from each other, and do not rotate. The brackets 473 and 474 have a gate-like shape to allow the revolving boss 472 to pass through the same, and light emitting portions 475*a* and 476*a* and light receiving portions 475*b* and 476*b*, which constitute the optical sensors, are respectively installed at the inner side of each of the brackets 473 and 474.

In the operation of the tension adjusting device according to another embodiment of the present invention, in the normal print mode as shown in FIG. 4, the rocking members 430*a* and 430*b* rotate such that the other ends thereof extend in a direction C. Accordingly, the auxiliary frame 410 moves in the direction C by the elastic force of the spring 442, and the tension roller 40 is pushed in the direction C, thereby applying a tension to the photoreceptor belt 10. In this state, the boss 472 of the rotary plate member 471 is located at a position where it cannot block light emitted from the light emitting portion 475*a* of the first optical sensor 475 and the light emitting portion 476*a* of the second optical sensor 476. This state, where the light receiving portion 475*b* of the first optical sensor 475 and the light receiving portion 476*b* of the second optical sensor 476 both can detect light, is recognized as a normal print mode.

When the mode is switched into the loosened tension mode due to suspension of the printing operation, the driving motor 460 operates in response to a printing stop signal, and the rotary plate member 471 rotates together with the rotation of the circular rotary plate 450. When the circular rotary plate 450 rotates clockwise a predetermined amount (approximately 90°), the rocking members 430*a* and 430*b* rotate such that the other ends thereof move toward a direction D, and the auxiliary frame 410 is simultaneously moved in the direction D. As a result, the pressure applied to the tension roller 40 is decreased and the tension roller 40 moves a predetermined distance in the direction D, thereby letting loose the tension applied to the photoreceptor belt 10. The rotary plate member 471 rotates counterclockwise, so that the boss 472 is located between the light emitting portion 475*a* and the light receiving portion 475*b* of the first optical sensor 475 installed in the bracket 473, blocking light from the light emitting portion 475*a* of the first optical sensor 475. When only the light receiving portion 476*b* of the second optical sensor 476 can detect the light as above, the control means recognizes this state as the loosened tension mode, and stops the operation of the driving motor 460.

When the driving motor 460 operates to switch modes into a belt replace mode to replace the worn photoreceptor belt 10, the circular rotary plate 450 in the normal print mode rotates clockwise 180°. Accordingly, the other ends of the rocking members 430*a* and 430*b* rotate in the direction D, intervening in the movement of the auxiliary frame 410. As a result, the auxiliary frame 410 and the tension roller 40 are sequentially moved to the end of the direction D, thereby completely releasing the tension applied to the photoreceptor belt 10. Here, the rotary plate member 471 rotates counterclockwise, and the boss 472 passes through the first optical sensor 475 and stops between the light emitting portion 476*a* and the light receiving portion 476*b* of the second optical sensor 476 installed in the bracket 474. As a result, light from the light emitting portion 476*a* of the second optical sensor 476 is blocked by the boss 472. When only the light receiving potion 475*b* of the first optical sensor 475 can detect light as above, the control means recognizes this mode as a belt replace mode and stops the operation of the driving motor 460.

The structure of the sensing member 470 performing the above function may be modified into various forms. For example, the first and second optical sensors 475 and 476 can be rotatably installed on the rotary plate member 471 while the boss 472 is fixed over the rotary plate member 471. Alternatively, the boss 472 may be installed on the circular rotary plate 450 without the rotary plate member 471 while the brackets 473 and 474 respectively having the first and second optical sensors 475 and 476 are fixed over the circular rotary plate 450. Also, three optical sensors can be installed to allow each optical sensor to recognize each of three modes. That is, the sensing means 370 may be implemented with two optical sensors and a boss that selectively blocks the lights from the two optical sensors.

As described above, the tension adjusting device according to another embodiment of the present invention can operate in three modes including the normal print mode, the loosened tension mode and the belt replace mode, by using the control means including the sensing means 470. Thus, as in the first embodiment, a partial stiffening and folding at the bent portions of the photoreceptor belt 10, due to the tension which is continuously applied even when the printing operation temporarily stops, can be prevented.

Figure 5:
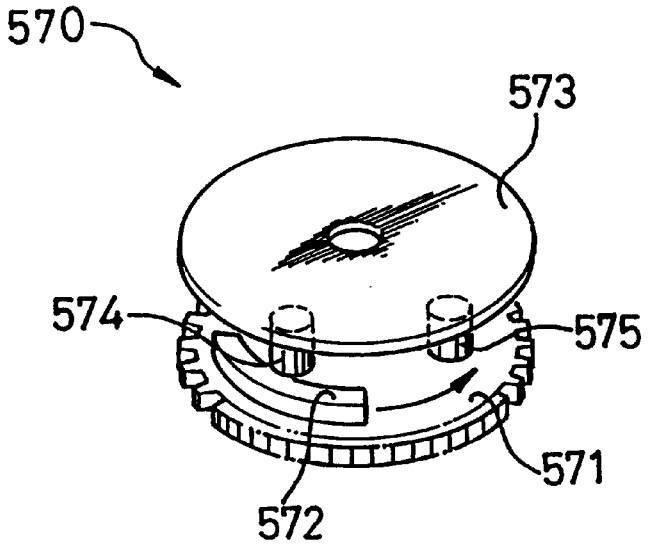
FIG. 5 is a perspective view of another example of the sensing means of FIG. 4.

FIG. 5 is a perspective view of another example of the sensing means shown in FIG. 4 according to the present invention. A sensing means 570 comprises a rotary plate member 571, a magnet 572 installed on the rotary plate member 571, a fixed plate member 573 and hall sensors 574 and 575.

The rotary plate member 571 is installed to be rotatable by a driving motor. The magnet 572 having a predetermined length is installed on the rotary plate member 571. The fixed plate member 573 is fixed over the rotary plate member 571, being separated from the rotary plate member 571 by a predetermined distance, and does not rotate, unlike the rotary plate member 571. The hall sensors 574 and 575 are fixed to the fixed plate member 573, being separated from each other by a predetermined distance, facing the magnet 572.

In the sensing means 570, when the magnet 572 passes below the hall sensors 574 and 575 with the rotation of the rotary plate member 571, the hall sensors 574 and 575 detect the passing of the magnet 572 and generate electrical signals. In a normal print mode, only the first hall sensor 574 generates an electrical signal in response to the movement of the magnet 572. Both the first and second hall sensors 574 and 575 generate an electrical signal in a loosened tension mode while only the second hall sensor 575 generates an electrical signal in a belt replace mode. Thus, the sensing means 570 can recognize three modes by the combination of the electrical signals generated by two hall sensors 574 and 575, and control the driving motor for each mode. Thus, the object of the present invention can be achieved. The above structure of the sensing means 570 can be modified into various forms as mentioned in the first and second embodiments.

Figure 6:
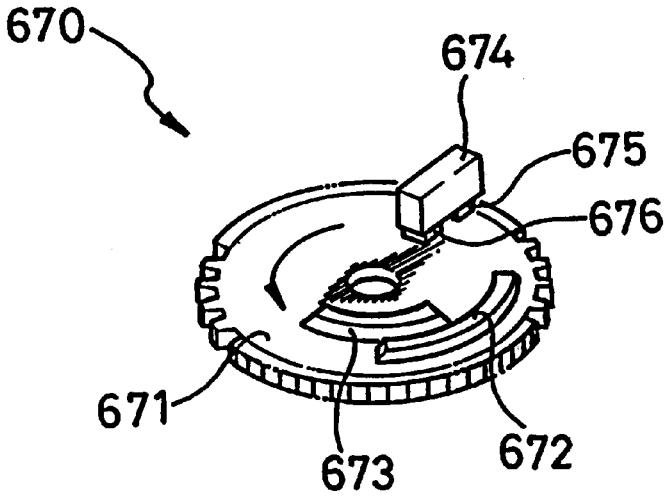
FIG. 6 is a perspective view of still another example of the sensing means of FIG. 4.

FIG. 6 is a perspective view of yet another example of the sensing means shown in FIG. 4 according to the present invention. A sensing means 670 includes a rotary plate member 671, two bosses 672 and 673, and a push button switch 674. The rotary plate member 671 is installed to be rotatable by a driving motor. The bosses 672 and 673 each having a predetermined length are installed on the rotary plate member 671. The push button switch 674 having two buttons 675 and 676 is fixed over the rotary plate member 671, being separated by a predetermined distance.

The sensing means 670 can recognize three modes by the combination of the two bosses 672 and 673 and the two buttons 675 and 676 of the push button switch 674. That is, while the first and second bosses 672 and 673 rotate with the rotation of the rotary plate member 671, they selectively interfere with the two buttons 675 and 677, which allows the sensing means 670 to recognize three modes. That is, only the first button 675 is interfered with by the first boss 672 in a normal print mode, and both the first and second buttons 675 and 676 are interfered with by the first and second bosses 672 and 673 in a loosened tension mode, respectively. Also, in a belt replace mode, only the second button 676 is interfered with by the second boss 673. The sensing means 670 can recognize three modes by the combination of on/off signals generated by the push button switch 674 having two buttons 675 and 676, and the control means can control the operation of the driving motor according to the modes.

As still another example of the sensing means, a rotary switch (or mode switch) which is not shown, may be adopted. The rotary switch, a switch for switching the mechanical contact due to the rotation of the rotor into an electrical signal, includes a rotor which is rotatable by a driving motor, and a stator which is fixed facing the rotor. Each of the rotor and the stator are provided with three contact points. The sensing means can recognize three modes as in the above examples according to the contact state of those points which changes as the rotor rotates by the driving motor.

In the above examples, a common feature of each example is that the tension adjusting devices according to the present invention includes a sensing means capable of detecting the position of a tension adjusting means, that is, three modes, as a control means for controlling the operation of a driving motor according to the detected three modes.

Alternatively, instead of detecting the position of the tension adjusting means, the control means may recognize three modes by detecting the load which is applied to the driving motor as the driving motor operates, and control the operation of the driving motor according to the modes. For example, in the tension adjusting device according to the first embodiment of the present invention shown in FIG. 3, the load to the driving motor is the biggest in the normal print mode and is the smallest in the belt replace mode. Also, a medium load is applied to the driving motor in the loosened tension mode. The object of the present invention can be achieved by adopting the control means capable of detecting the load to the driving motor.

As described above, in the tension adjusting device according to the present invention, during the suspension of the printing operation, the mode can be switched into a loosened tension mode where the tension applied to the photoreceptor belt can be loosened without damage to the photoreceptor belt. Thus, a partial stiffening and folding at the bent portions of the photoreceptor belt can be prevented, improving the development quality and the lifetime of the photoreceptor belt.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A tension adjusting device for printing apparatuses, comprising:

means for rotatably supporting a tension roller;

means for adjusting tension applied to a photoreceptor belt by either one of pushing the tension roller in a direction to apply tension to the photoreceptor belt, and by releasing the tension from the photoreceptor belt;

a driving motor for driving the tension adjusting means; and means for controlling an operation of the driving motor such that the tension adjusting means operates in three modes including a normal print mode where the tension is applied to the photoreceptor belt for a normal printing, a loosened tension mode where the tension to the photoreceptor belt is loosened due to suspension of a printing operation, and a belt replace mode where the tension to the photoreceptor belt is released to replace the photoreceptor belt.

2. The tension adjusting device of claim 1, wherein the control means comprises means for sensing a position of the tension adjusting means, and the control means recognizes the modes according to the position of the tension adjusting means, detected by the sensing means as the driving motor operates, and controls the driving motor according to the detected mode.

3. A tension adjusting device for printing apparatuses, comprising:

means for rotatably supporting a tension roller;

means for adjusting tension applied to a photoreceptor belt by either one of pushing the tension roller in a direction to apply tension to the photoreceptor belt, and by releasing the tension from the photoreceptor belt;

a driving motor for driving the tension adjusting means; and means for controlling an operation of the driving motor such that the tension adjusting means operates in three modes including a normal print mode where the tension is applied to the photoreceptor belt for a normal printing, a loosened tension mode where the tension to the photoreceptor belt is loosened due to suspension of a printing operation, and a belt replace mode where the tension to the photoreceptor belt is released to replace the photoreceptor belt;

wherein the control means comprises means for sensing a position of the tension adjusting means, and the control means recognizes the modes according to the position of the tension adjusting means, detected by the sensing means as the driving motor operates, and controls the driving motor according to the detected mode;

wherein the sensing means comprises sensor operating means installed to be rotatable by the driving motor, and at least two sensors installed, being separated from each other by a first predetermined distance, and the sensor operating means rotates to selectively operate the sensors, and the sensing means detects the position of the tension adjusting means from signals generated by the sensors.

4. The tension adjusting device of claim 3, wherein the sensor operating means is a slit provided in a rotary plate member installed to be rotatable by the driving motor, and the sensors are optical sensors installed in two fixed plate members which are located at both sides of the rotary plate member, being separated by a second predetermined distance, wherein the slit which revolves with a rotation of the rotary plate member, selectively allows light to pass from the optical sensors.

5. The tension adjusting device of claim 3, wherein the sensor operating means is a boss provided along a part of a circumference of a rotary plate member installed to be rotatable by the driving motor, and the sensors are optical sensors respectively installed in at least two brackets which are fixed over the rotary plate member, being separated by a second predetermined distance, wherein the boss which revolves with a rotation of the rotary plate member, selectively allows light to pass from the optical sensors.

6. The tension adjusting device of claim 3, wherein the sensor operating means is a magnet provided in a rotary plate member installed to be rotatable by the driving motor, and the sensors are hall sensors installed in a fixed plate member which is fixed over the rotary plate member, being separated by a second predetermined distance, wherein the magnet which revolves with a rotation of the rotary plate member, selectively operates the hall sensors.

7. A tension adjusting device for printing apparatuses, comprising:

means for rotatably supporting a tension roller;

means for adjusting tension applied to a photoreceptor belt by either one of pushing the tension roller in a direction to apply tension to the photoreceptor belt, and by releasing the tension from the photoreceptor belt;

a driving motor for driving the tension adjusting means; and means for controlling an operation of the driving motor such that the tension adjusting means operates in three modes including a normal print mode where the tension is applied to the photoreceptor belt for a normal printing, a loosened tension mode where the tension to the photoreceptor belt is loosened due to suspension of a printing operation, and a belt replace mode where the tension to the photoreceptor belt is released to replace the photoreceptor belt;

wherein the control means comprises means for sensing a position of the tension adjusting means, and the control means recognizes the modes according to the position of the tension adjusting means, detected by the sensing means as the driving motor operates, and controls the driving motor according to the detected mode;

wherein the sensing means comprises a rotary plate member installed to be rotatable by the driving motor, at least two bosses installed on a surface of the rotary plate member, and a push button switch which is fixed over the rotary plate member being separated by a first predetermined distance, and has at least two buttons, wherein the sensing means detects the position of the tension adjusting means by on/off signals which are generated by the push button switch when each of at least two bosses selectively interferes with the buttons with a rotation of the rotary plate member.

8. A tension adjusting device for printing apparatuses, comprising:

means for rotatably supporting a tension roller;

means for adjusting tension applied to a photoreceptor belt by either one of pushing the tension roller in a direction to apply tension to the photoreceptor belt, and by releasing the tension from the photoreceptor belt;

a driving motor for driving the tension adjusting means; and means for controlling an operation of the driving motor such that the tension adjusting means operates in three modes including a normal print mode where the tension is applied to the photoreceptor belt for a normal printing, a loosened tension mode where the tension to the photoreceptor belt is loosened due to suspension of a printing operation, and a belt replace mode where the tension to the photoreceptor belt is released to replace the photoreceptor belt;

wherein the control means recognizes the modes according to a load which is applied to the driving motor as the driving motor operates, and controls the driving motor according to a detected mode.

9. A tension adjusting device for printing apparatuses, comprising:

an auxiliary frame installed on a main frame for rotatably supporting a tension roller;

a mechanism for adjusting tension applied to a photoreceptor belt by either one of pushing the tension roller in a direction to apply tension to the photoreceptor belt, and by releasing the tension from the photoreceptor belt;

wherein said tension adjusting mechanism includes:

a fixed frame fixed to the main frame, the fixed frame having a hole at a center portion through which a guide bar is inserted to be movable, a coupling pin which couples one end of the guide bar to the auxiliary frame, a spring installed around the guide bar, an eccentric cam rotatably installed at the other end of the guide bar to control an elastic force applied to the spring, and a pressing ring installed around the guide bar for pressing the spring with a rotation of the eccentric cam;

a driving motor for driving the eccentric cam of the tension adjusting mechanism; and a mechanism for controlling an operation of the driving motor such that the tension adjusting mechanism operates in three modes including a normal print mode where the tension is applied to the photoreceptor belt for a normal printing, a loosened tension mode where the tension to the photoreceptor belt is loosened due to suspension of a printing operation, and a belt replace mode where the tension to the photoreceptor belt is released to replace the photoreceptor belt.

* * * * *